US006328826B1

(12) United States Patent
Iung et al.

(10) Patent No.: US 6,328,826 B1
(45) Date of Patent: Dec. 11, 2001

(54) METHOD OF FABRICATING "TRIP" STEEL IN THE FORM OF THIN STRIP, AND THIN STRIP OBTAINED IN THIS WAY

(75) Inventors: Thierry Iung, Plappeville; Odile Faral, Metz; Michel Faral, Metz; Michel Babbit, Metz; Christophe Issartel, Arles, all of (FR)

(73) Assignee: Usinor, Puteaux (FR)

( * ) Notice: Subject to any disclaimer, the term of this patent is extended or adjusted under 35 U.S.C. 154(b) by 0 days.

(21) Appl. No.: 09/621,089

(22) Filed: Jul. 21, 2000

(30) Foreign Application Priority Data

Jul. 30, 1999 (FR) ..... 99 10060

(51) Int. Cl.[7] ..... C21D 8/00
(52) U.S. Cl. ..... 148/541; 148/602
(58) Field of Search ..... 148/541, 602, 148/656, 657, 658

(56) References Cited

U.S. PATENT DOCUMENTS

| | | | | |
|---|---|---|---|---|
| 5,470,539 | | 11/1995 | Nomura et al. | 420/103 |
| 5,567,250 | * | 10/1996 | Akamatsu et al. | 148/320 |
| 6,027,587 | * | 2/2000 | Hodgson et al. | 148/654 |
| 6,210,496 | * | 4/2001 | Takagi et al. | 148/333 |

FOREIGN PATENT DOCUMENTS

| | | |
|---|---|---|
| 0 666 332 | 8/1995 | (EP) . |
| 0881 306 | 12/1998 | (EP) . |
| 60-043425 A * | 3/1995 | (JP) . |
| WO 98/20180 | 5/1998 | (WO) . |

* cited by examiner

*Primary Examiner*—George Wyszomierski
*Assistant Examiner*—Janelle Combs-Morillo
(74) *Attorney, Agent, or Firm*—Oblon, Spivak, McClelland, Maier & Neustadt, P.C.

(57) ABSTRACT

The invention provides a method of fabricating "TRIP" steel in the form of thin strip, wherein:

a strip from 1.5 to 10 mm thick, preferably from 1 to 5 mm thick, is cast directly from liquid steel having the composition (in weight percent) C % from 0.05 to 0.25, (Mn+Cu+Ni) % from 0.5 to 3, (Si+Al) % from 0.1 to 4, (P+Sn+As+Sb) % not greater than 0.1, (Ti+Nb+V+Zr+rare earths) % less than 0.3, Cr % less than 1, Mo % less than 1, V % less than 1, the remainder being iron and manufacturing impurities;

said strip is hot rolled on-line in one or more passes at a temperature higher than the $Ar_3$ temperature of said steel and with a reduction ratio from 25 to 70%;

first forced cooling of said strip is carried out at a cooling rate from 5 to 100° C./s;

the strip remains at temperatures from 550 to 400° C. for the time needed for bainitic transformation to occur therein with a residual austenite content greater than 5%, while preventing the formation of perlite, after which the transformation is interrupted by second forced cooling of said strip to a temperature below 400° C.; and said strip is coiled at a temperature below 350° C.

12 Claims, No Drawings

METHOD OF FABRICATING "TRIP" STEEL IN THE FORM OF THIN STRIP, AND THIN STRIP OBTAINED IN THIS WAY

The invention relates to the continuous casting of steel in the form of thin strip. It relates more particularly to the fabrication of "TRIP" steel in the form of thin strip directly from liquid metal.

TRansformation Induced Plasticity (TRIP) steel combines high strength and high ductility, which makes it particularly suitable for shaping. These properties are obtained by virtue of its particular microscopic structure. It has, within a ferritic matrix, a hard bainite and/or martensite phase and residual austenite representing from 5 to 20% of the structure. TRIP steel plate is usually obtained either by continuous casting of slabs followed by hot rolling (the quickest method, and therefore the most economic, but which produces relatively thick products) or by continuous casting of slabs followed by hot rolling, cold rolling and annealing (the method used for thin products). The bainite stabilizes the austenite.

The following problem makes it difficult to make high-quality TRIP steel plate from strip obtained by the conventional continuous casting and hot rolling method. After hot rolling the initial slab, the austenite has to be stabilized during the bainitic transformation that occurs during coiling of the strip, which takes place at a temperature of 400° C. (±50° C.). The hot-rolled strip is cooled to its coiling temperature by sprinkling it with water. This cooling occurs in a range of temperatures in which a phenomenon referred to as "rewetting" can occur. This phenomenon is caused by the instability of steam in contact with the strip caused by Leidenfrost's phenomenon, some of the steam returning to the liquid state. The resulting localized contact between the strip and liquid water, rather than steam, leads to inconsistent quenching of the strip. Inconsistent cooling leads to significant inconsistencies in the microstructure of the strip, degrading its mechanical properties.

The object of the invention is to make it possible to produce high-quality TRIP steel strip reliably on a short production line, i.e. one that does not include any cold rolling or annealing step.

To this end, the invention provides a method of fabricating "TRIP" steel in the form of thin strip, wherein:

- a strip from 1.5 to 10 mm thick, preferably from 1 to 5 mm thick, is cast directly from liquid steel having the composition (in weight percent) C% from 0.05 to 0.25, (Mn+Cu+Ni) % from 0.5 to 3, (Si+Al) % from 0.1 to 4, (P+Sn+As+Sb) % not greater than 0.1, (Ti+Nb+V+Zr+rare earths) % less than 0.3, Cr % less than 1, Mo % less than 1, V % less than 1, the remainder being iron and manufacturing impurities;
- said strip is hot rolled on-line in one or more passes at a temperature higher than the $Ar_3$ temperature of said steel and with a reduction ratio from 25 to 70%;
- first forced cooling of said strip is carried out at a cooling rate from 5 to 100° C./s;
- the strip remains at temperatures from 550 to 400° C. for the time needed for bainitic transformation to occur therein with a residual austenite content greater than 5%, whilst preventing the formation of perlite, after which the transformation is interrupted by second forced cooling of said strip to a temperature below 400° C.; and
- said strip is coiled at a temperature below 350° C.

The invention also provides thin "TRIP" steel strip obtained by the above method.

Clearly a first essential aspect of the invention is the continuous casting of the steel to form thin strip directly from the liquid metal, instead of the standard process of casting slabs to be hot rolled on a strip mill. The strip produced in this way is hot rolled on-line and then cooled to the range of temperatures in which the bainitic transformation occurs. It is only when that transformation has occurred and the required microstructure typical of TRIP steel has been obtained that further cooling is applied, which interrupts the transformation and cools the strip towards its coiling temperature. That temperature is lower than that of hot-rolled strip produced by the conventional process because the bainitic transformation has already occurred and because maintaining the coiled strip in the range of temperatures at which the transformation occurred would entail the risk of undesirable changes to the microstructure.

The invention will be better understood after reading the following description.

The technique of continuously casting thin strip directly from liquid metal has been used experimentally for several years to cast carbon steel, stainless steel and other ferrous alloys, but has not yet been used to fabricate TRIP steel. In the technique most widely used to cast ferrous alloys in the form of thin strip, which is in the process of becoming an industrial technique and is referred to as "twin-roll casting", liquid metal is fed between two closely spaced horizontal rolls rotating in opposite directions and cooled internally. The casting space is closed off laterally by refractory plates pressed against the plane lateral faces of the rolls. Solidified metal "skins" form on each roll and join at the roll gap (the area in which the distance between the cylindrical lateral surfaces of the rolls is the smallest and substantially corresponds to the required thickness of the strip) to form a solidified strip. Before it is coiled, the strip can be subjected to various heat and/or thermomechanical treatments, such as one or more hot rolling passes, cooling, reheating, etc. One particular combination of such treatments constitutes one essential feature of the invention.

According to the invention, a steel is cast whose composition is defined as follows (all the percentages stated are weight percentages).

Its carbon content is from 0.05 to 0.25%. The lower limit is necessary for stabilizing the residual austenite, which occurs on cooling the strip by virtue of rejection of carbon from the ferritic phase into the austenitic phase. Above 0.25% it is considered that the strip would not have sufficient weldability for the usual applications of TRIP steel.

Its manganese content is from 0.5 to 3%. The functions of the manganese are to stabilize the austenite (it is a gammagenic element) and to harden the steel.

Below 0.5% these effects are not sufficiently marked. Above 3% the gammagenic effect becomes too high to guarantee the formation of a ferritic matrix and there is exaggerated segregation of the manganese, which degrades the mechanical properties of the strip. The manganese can be partly replaced with copper and/or nickel, which also have gammagenic effects.

A copper content from 0.5 to 2% can optionally be imposed (whilst remaining within the specified range from 0.5 to 3% for the Mn+Cu+Ni). The added copper specifically provides precipitation hardening. Moreover, because the copper is insoluble in the cementite, it has a beneficial effect on the residual austenite, like silicon and aluminium. Also, the fast cooling conditions imposed by casting thin strip avoid problems of deterioration of the surface state of the product such that adding copper is contra-indicated in TRIP steel produced by the conventional processes.

The total content of silicon and aluminium is from 0.1 to 4%. These elements prevent the precipitation of cementite in the austenite and encourage the formation of ferrite at high temperature. The method of the invention allows higher silicon contents than is usual for TRIP steel (from 0.2 to 1.5% for reasons and under conditions explained below.

The cumulative content of phosphorus, tin, arsenic and antimony must not exceed 0.3%, to limit the fragility of the products, and the phosphorus content preferably does not exceed 0.05%.

Titanium, niobium, vanadium, zirconium and rare earths can also be added in a total amount not exceeding 0.3%. These elements form carbides, nitrides or carbonitrides which block grain growth at high temperature and increase strength by precipitation.

Finally, it is necessary to avoid the excessive presence of elements which would slow down the bainitic transformation. This applies to chromium, molybdenum and vanadium. In any event, the contents of each of these elements must preferably not exceed 1%. Their total concentration must not exceed 0.3% and more preferably 0.05%.

The other elements present in the steel are those usually found as manufacturing impurities, in proportions which have no significant effect on the required properties of TRIP steel.

A liquid metal whose composition conforms to the criteria previously stated is cast continuously on a twin-roll casting installation to form a solidified strip whose thickness can be from 0.5 to 10 mm and more conventionally from 1 to 5 mm. On leaving the rolls, the strip preferably passes through an inerting area, such as a sealed enclosure in which an atmosphere which cannot oxidize the metal is maintained in the vicinity of the strip by blowing in a neutral gas (nitrogen or argon) to reduce the oxygen concentration to a very low level. This atmosphere can also be given reducing properties by introducing hydrogen into it.

The object of this inerting is to avoid, or at least to significantly reduce, the formation of scale on the surface of the strip, whose presence during the following hot rolling step would lead to defects such as embedding scale in the surface of the strip. The inerting device can be replaced or complemented by a device for removing any scale that is formed, for example a system of rotating brushes. One benefit of using an inerting and/or descaling system of this kind before hot rolling is that it enables the permitted silicon content of the metal to be increased. In the conventional method of fabricating TRIP steel by casting slabs and hot rolling it is usually preferable to avoid imposing a silicon content greater than 0.25%, as otherwise the scale formation conditions are generally such that large quantities of fayalite (oxide of iron and silicon) appear, which is very difficult to remove before hot rolling. In conventional installations in which the slabs are cast and cooled in the open air, the cast slabs, already carrying a large amount of scale, remain at ambient temperature and must be reheated in a large furnace (which is therefore difficult to render inert) located off the casting line before it is sent to the strip mill. To prevent the formation of scale strongly charged with fayalite so as to obtain a correct surface state of the strip it is therefore preferable, on the usual production line for fabricating hot-rolled TRIP steel, to limit the silicon content of the metal to the value previously cited, although higher contents would have significant metallurgical advantages, as already stated. From this point of view, the use of twin-roll casting with on-line hot rolling has the advantage that it makes it much easier to prevent or limit the formation of fayalite (or to remove any fayalite that may have formed) in the short distance between casting and rolling than in a conventional installation.

After it has been cast, and after it has passed through the inerting area, if any, the strip is then hot-rolled on-line, in a manner known in the art, to a thickness which is generally from 1 to 3 mm. This rolling must be carried out in the austenitic domain, and therefore at a temperature higher than the $Ar_3$ temperature of the grade as cast. It is effected with a total reduction ratio from 25 to 70%. This on-line hot-rolling has two functions. Firstly, it must close any porosities that may have formed in the core of the strip during solidification. It must above all "break" the microstructure resulting from solidification in order to refine it and to make it possible to obtain the required final microstructure. This hot rolling can take place in one or more passes, i.e. by passing the strip through a single roll stand, or by passing the strip through successive stands, the first applying a small reduction in order to close the porosities and the remainder producing the final thickness. The following combinations of cast thickness/hot-rolling reduction ratio/final thickness may be proposed by way of example:

TABLE 1 examples of cast thickness/hot-rolling reduction ratio/final thickness combinations

| Initial strip thickness (mm) | Reduction ratio (%) | Final strip thickness (mm) |
|---|---|---|
| 4 | 25 | 3 |
| 4 | 50 | 2 |
| 2 | 40 | 1.2 |
| 1.5 | 40 | 0.9 |
| 1 | 60 | 0.6 |

After hot rolling, the strip is forcibly cooled a first time, for example by sprinkling it with water. The aim of this cooling is to form a ferritic structure within the strip, whilst preventing the appearance of perlite. To this effect, it must be carried out at a cooling rate from 5 to 100° C./s, preferably from 25 to 80° C./s, which is perfectly compatible with the standard technologies for cooling strip having the thickness concerned. Too low a cooling rate would lead to the appearance of perlite, which would make the bainitic transformation, which is one of the essential features of the invention, impossible. Too high a cooling rate would entail the risk of not obtaining the required ferritic structure for the matrix, as the structure would go directly to the bainite domain, or even to the martensite domain. The preferred range of cooling rates makes obtaining an optimum result more likely.

The rate and duration of this first cooling must be such that the strip is brought to a thermal state allowing it to remain in air in the range of temperatures from 550 to 400° C., preferably from 530 to 470° C. (in order to obtain the required austenite levels for reasonable holding times, whilst guaranteeing that no perlite is formed) for the time needed for bainitic transformation to occur to stabilize the remaining austenite proportion to more than 5%, whilst preventing the formation of perlite. Once this result has been obtained, the strip is forcibly cooled again, for example by sprinkling it with water, to take the strip out of the preceding temperature range (and therefore to a temperature below 400° C.), and preferably to a coiling temperature, which must be less than 350° C. This coiling temperature range is chosen to prevent any major change to the structure of the coiled strip, such as precipitation of carbides, which would destabilize the austenite.

The time for which the strip remains in air without forced cooling needed to obtain the required bainitic transformation varies with the precise casting parameters, namely the composition of the strip and its speed in the corresponding area of the installation. This time must be determined experimentally, using standard transformation curves for the grades of steel concerned, and as a function of the precise residual austenite content to be obtained. A high austenite content improves ductility but an austenite content below 5% at the end of bainitic transformation would form insufficient martensite to obtain the TRIP effect. For example, with a grade containing 0.2% carbon, 1.5% manganese and 1.5% silicon, an austenite content of 6% is obtained if the strip is maintained at 470° C. for 10 s or at 530° C. for 20 s. In practice, the duration of this period can generally be from 5 to 30 s.

Assuming that the cast strip has an initial thickness of 3 mm and travels at 60 m/min on leaving the rolls (which is routine for a twin-roll casting installation), the speed of the hot-rolled strip in the bainitic transformation area varies according to the hot-rolling reduction ratio. Table 2 gives examples of the speed of the strip in the bainitic transformation area as a function of the hot-rolling reduction ratio, based on the preceding hypotheses.

TABLE 2 strip speed in bainitic transformation area as a function of hot-rolling reduction ratio (cast thickness 3 mm, casting speed 60 m/min)

| Reduction ratio (%) | Strip speed (m/s) |
|---|---|
| 25 | 1.3 |
| 40 | 1.7 |
| 60 | 2.5 |
| 70 | 2.3 |

Under the above conditions, if it is decided to impose an end of rolling temperature of 900° C. on the strip, a rate of cooling in the first sprinkling area of 50° C./s, a period of 10 s at 500° C. in the bainitic transformation area and a cooling rate in the second sprinkling area of 50° C./s to cool the strip to a temperature below 250° C., the strip will take 20 to 25 s to travel from the mill stand to the coiler. If these two units are approximately 40 m apart, which is reasonable for a standard twin-roll casting installation, the speed of the strip after rolling must therefore be approximately 2 m/s, which is totally compatible with the conclusions drawn from Table 2. From the technological point of view, implementing the method of the invention will not pose any major problems. To obtain the required result, it is also possible to adjust the length of the cooling areas and the flowrate of the cooling liquid in each area. To this end, if the cooling areas comprise a succession of water sprinkler manifolds, using a varying number of manifolds allows flexible adjustment of the lengths of these areas.

Clearly the essential step of the method according to the invention is that in which the strip remains in the bainitic transformation domain after hot rolling, on which the second cooling imposes a brief duration, and coiling the strip in a range of temperatures in which the bainitic transformation has already occurred. This prevents the bainitic transformation being affected by the phenomenon of rewetting and reliably obtains a homogeneous microstructure within the strip. Making the strip by twon-roll casting (or, more generally, by casting thin strip from 1.5 to 10 mm thick and in particular from 1 to 5 mm thick) directly and hot rolling it on-line is a virtually indispensable precondition to the economic viability of producing the bainitic transformation under the above conditions. It would be feasible to perform the bainitic transformation by maintaining a strip leaving a conventional strip mill at 550 to 400° C. for a period from one to a few seconds. However, given the usual speed of the strip at the exit from a strip mill, which is significantly higher than the speed on leaving an on-line rolling mill in a casting between cylinders production line, that would require an inordinate distance (of the order of 500 m) between the exit from the strip mill and the coiler, which would totally eliminate the economic benefit of this solution. Moreover, by hot rolling and performing the bainitic transformation on-line with casting there is no need for intermediate reheating, which is costly in terms of energy. Finally, the metallurgical transformations employed by the method according to the invention, in which the temperature of the strip only decreases between casting and coiling, cannot be impeded by structures that would have been obtained following a first cooling of the product to ambient temperature and would remain at least in the residual state after reheating preceding hot rolling. This could be the case if the fabrication line between the casting of the initial semi-finished product and the coiling of the final strip were discontinuous.

After coiling, the strip obtained by the method according to the invention is ready for use in the same way as trip steel strip of the same composition obtained by the conventional process of continuous casting of slabs and hot rolling.

What is claimed is:

1. A method of fabricating transformation induced plasticity steel in the form of thin strip, comprising:

casting a strip from 1.5 to 10 mm thick directly from liquid steel comprising (in weight percent) C% from 0.05 to 0.25, (Mn+Cu+Ni) % from 0.5 to 3, (Si+Al) % from 0.1 to 4, (P+Sn+As+Sb) % not greater than 0.1, (Ti+Nb+V+Zr+rare earths) % less than impurities;

hot-rolling said strip on-line in one or more passes at a temperature higher than the $Ar_3$ temperature of said steel and with a reduction ratio from 25 to 70%;

first forced cooling of said strip at a cooling rate from 5 to 100° C./s;

holding the strip at a temperature of from 550 to 400° C. for the time needed for bainitic transformation to occur therein with a residual austenite content greater than 5%, whilst preventing the formation of perlite;

interrupting the transformation by second forced cooling of said strip to a temperature below 400° C.; and coiling said strip at a temperature below 350° C.

2. A method according to claim 1, wherein the phosphorus content of the steel does not exceed 0.05%.

3. A method according to claim 1 wherein the total content of chromium, molybdenum and vanadium does not exceed 0.3%.

4. A method according to claim 3, wherein the total content of chromium, molybdenum and vanadium does not exceed 0.05%.

5. A method according to claim 1 wherein the copper content is from 0.5 to 2%.

6. A method according to claim 1, wherein the cooling rate of the first cooling is from 25 to 80° C./s.

7. A method according to claim 1, wherein after the first cooling the strip remains at a temperature from 530 to 470° C. for the time needed for a bainitic transformation to occur therein with a residual austenite content greater than 5%, whilst preventing the formation of perlite.

8. A method according to claim 1, wherein the time for which said strip remains in the temperature range at which the bainitic transformation occurs is from 5 to 30 s.

9. A method according to claim 1, wherein said second cooling cools said strip to its coiling temperature.

10. A method according to claim 1 wherein between casting it and hot rolling it said strip passes through an area in which an atmosphere that does not oxidize the metal is contained in the vicinity of its surface.

11. A method according to claim 1, wherein scale is removed from the surface of said strip before it is hot rolled.

12. A method according to claim 1, wherein said strip is cast between two closely spaced horizontal rolls rotated in opposite directions and cooled internally.

* * * * *

UNITED STATES PATENT AND TRADEMARK OFFICE

CERTIFICATE OF CORRECTION

PATENT NO. : 6,328,826 B1
DATED : December 11, 2001
INVENTOR(S) : Thierry Iung et al.

It is certified that error appears in the above-identified patent and that said Letters Patent is hereby corrected as shown below:

Column 6,
Line 39, "(Ti + Nb + V + Zr + rare earths)% less than impurities;" should read
-- (Ti + Nb + V + Zr + rare earths)% less than 0.3, Cr% less than 1, Mo% less than 1, V% less than 1, balance iron and manufacturing impurities; --

Signed and Sealed this

Twentieth Day of May, 2003

JAMES E. ROGAN
*Director of the United States Patent and Trademark Office*